US005150625A

United States Patent [19]

Mishler

[11] Patent Number: 5,150,625

[45] Date of Patent: Sep. 29, 1992

[54] GYROSCOPIC DEVICE

[76] Inventor: Frederick H. Mishler, 38561 Tindle Creek Rd., Willamina, Oreg. 97396

[21] Appl. No.: 638,337

[22] Filed: Jan. 7, 1991

[51] Int. Cl.[5] ..... A63B 69/00; A63B 11/04

[52] U.S. Cl. ..... 74/5 R; 446/233

[58] Field of Search ..... 74/5 R, 5.22, 573 F, 74/573 R; 446/233, 258, 234, 235; 73/458, 468, 469, 470; 272/128; 264/311, DIG. 27, DIG. 67

[56] References Cited

U.S. PATENT DOCUMENTS

| | | | |
|---|---|---|---|
| 942,952 | 12/1909 | Wrather | 446/235 |
| 1,209,730 | 12/1916 | Leblanc | 73/468 X |
| 2,815,584 | 12/1957 | Watson | 74/56 E X |
| 3,164,654 | 1/1965 | Spencer | 264/311 |
| 3,191,997 | 6/1965 | Colvert | 73/458 X |
| 3,365,351 | 1/1968 | Maaz et al. | 264/311 X |
| 3,726,146 | 4/1973 | Mishler | 74/5 R |
| 4,060,009 | 11/1977 | Wyman | 74/573 R |
| 4,150,580 | 4/1979 | Silkebakken et al. | 74/5 R |
| 4,683,681 | 8/1987 | Russ | 74/573 R X |
| 4,982,954 | 1/1991 | Lazar | 272/128 X |

*Primary Examiner*—Rodney H. Bonck
*Attorney, Agent, or Firm*—Eugene M. Eckelman

[57] ABSTRACT

A gyroscopic rotor has a shaft with opposite ends rotatably supported in a housing on a first or spin axis and capable of rotating around the housing at right angles to the spin axis, comprising a second axis. The support of the shaft in the housing is a circular track concentric with the second axis and positioned on opposite sides of and adjacent the ends of the shaft for rolling contact by end portions of the shaft when a torque is applied to the housing about a third axis at right angles to both the spin and second axis whereby to cause precession of the shaft and rotor about the second axis. The track comprises a circumferential groove with opposed surfaces of a type having a friction engagement with the end of the shaft to provide an improved rolling precessional movement of the shaft and rotor. A ring is supported in the circumferential groove and has notches receiving end portions of the shaft for establishing a drive connection between the shaft and the guide ring. This guide ring has free sliding movement against the opposed surfaces of the groove. The housing is formed of a pair of sections which permit access to the track for repair and maintenance. The device includes electrical generating portions capable of supplying power to visual and/or audio devices forming a part of the housing.

3 Claims, 3 Drawing Sheets

GYROSCOPIC DEVICE

BACKGROUND OF THE INVENTION

This invention relates to new and useful improvements in gyroscopic devices and to a process of generating electricity thereby.

Gyroscopic novelty devices have heretofore been provided. One such device is shown in U.S. Pat. No. 3,726,146. Such prior device employs a rotor positioned in a support having an internal circular portion provided with an internal race or groove. The rotor is secured to a shaft extending diametrically across the circular portion with its ends received in the race. A guide ring is positioned in the race so as to be rotatable circumferentially of the race. The guide ring has diametrically spaced notches in its inner periphery that receive the ends of the rotor shaft for maintaining them centered and 180 degrees apart in the race. The rotor can thus rotate about the axis of the rotor shaft as a first or spin axis and also about the axis of rotation of the ring which comprises a second axis at right angles to and intersecting the spin axis. By giving the rotor an initial spin and then holding its support in the hand and manually applying a torque to the support at a third axis at right angles to both the spin and second axes, the rotor will precess about the second axis. By manually gyrating the axis of the applied torque about the second axis at the same rate and in the same direction as the precession of the rotor, the opposite ends of the rotor shaft are continuously pressed against the opposite sides of the race. The precession is continuous and causes the ends of the rotor shaft to roll on the upper and lower surfaces of the race in a manner which increases or decreases the rate of rotor spin in proportion to the amount of torque applied by the operator. A skillful operator can cause the rotor to attain high speeds of rotation about its spin axis.

SUMMARY OF THE INVENTION

According to the present invention and forming a primary objective thereof, a gyroscopic device is provided that possesses valuable improvements over structures such as that shown in U.S. Pat. No. 3,726,146.

More particular objects are to provide a gyroscopic device of the type described that due to improved race bearing surfaces will precess more efficiently and quietly; that is enclosed in a housing that normally is closed but that can be opened up to gain access to the interior for periodic cleaning and maintenance; and that includes electrically operated audio and/or visual display means in a structure and process powered by electrical generating and control means associated with the precessing rotor.

In carrying out the objectives of the invention the gyroscopic device comprises a housing with a balanced rotor therein. A shaft is integrated with the rotor and provides a spin axis for the rotor. The ends of the shaft are supported in a race or groove for rotation about a second axis at right angles to the spin axis. This race provides a track for rolling contact by the ends of the shaft when a torque is applied to the housing on a third axis at right angles to both the spin axis and the second axis. The race has opposed friction surfaces that provide efficient rolling contact thereon by the end portions of the shaft. The shaft ends are engaged in notches of a low friction guide ring that moves with the shaft and rotor, the low friction material providing free sliding movement of the guide ring in the race. The housing is formed of a pair of sections that are detachable at the race whereby to permit access to internal parts for repair and maintenance. It is within the concept of the present invention to include permanent magnet and coil means in the housing and rotor that are capable of generating electricity upon rotation of the rotor for powering audio and/or visual means in the housing.

The invention will be better understood and additional objects and advantages will become apparent from the following description taken in connection with the accompanying drawings.

DETAILED DESCRIPTION OF PREFERRED EMBODIMENTS

Figure 1:
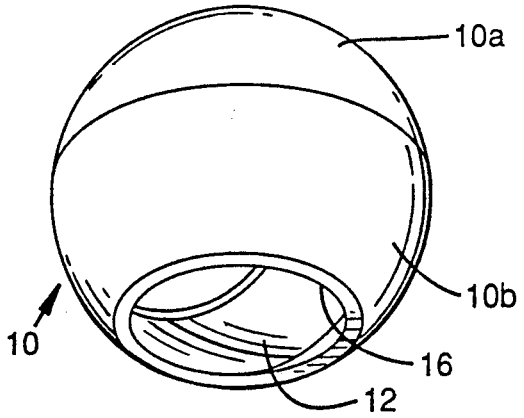
FIG. 1 is a perspective view of the present gyroscopic device taken end.
Figure 2:
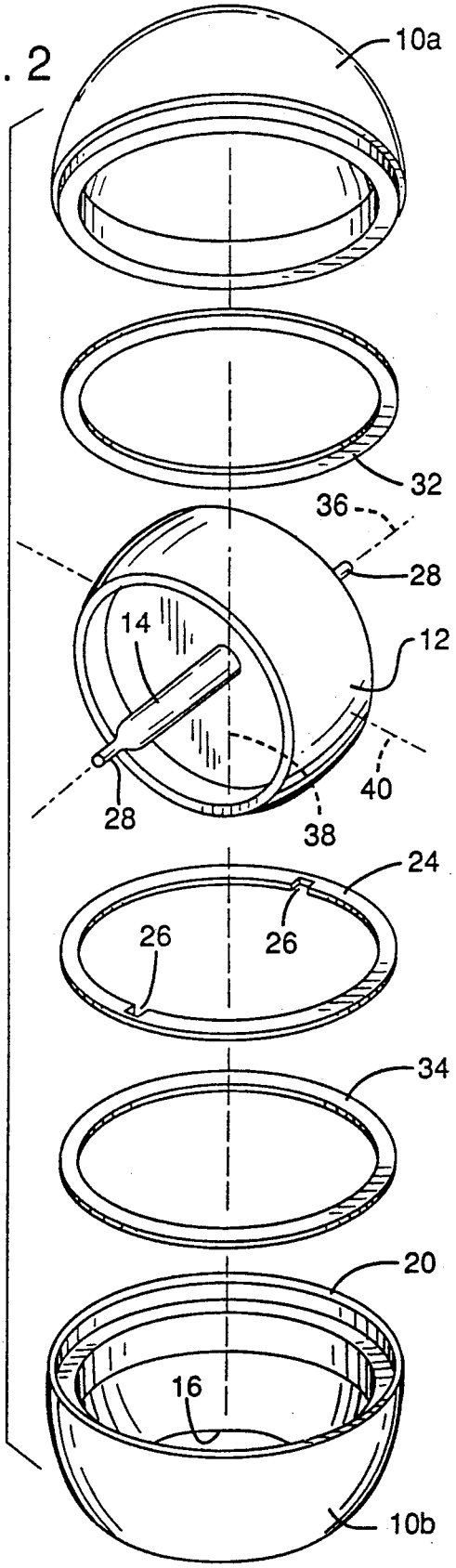
FIG. 2 is an exploded view of the device showing primary structural the gyroscope.
Figure 4:
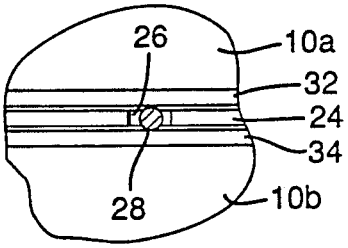
FIG. 4 is a fragmentary sectional view taken on the line 4—4 of FIG. 3.
Figure 3:
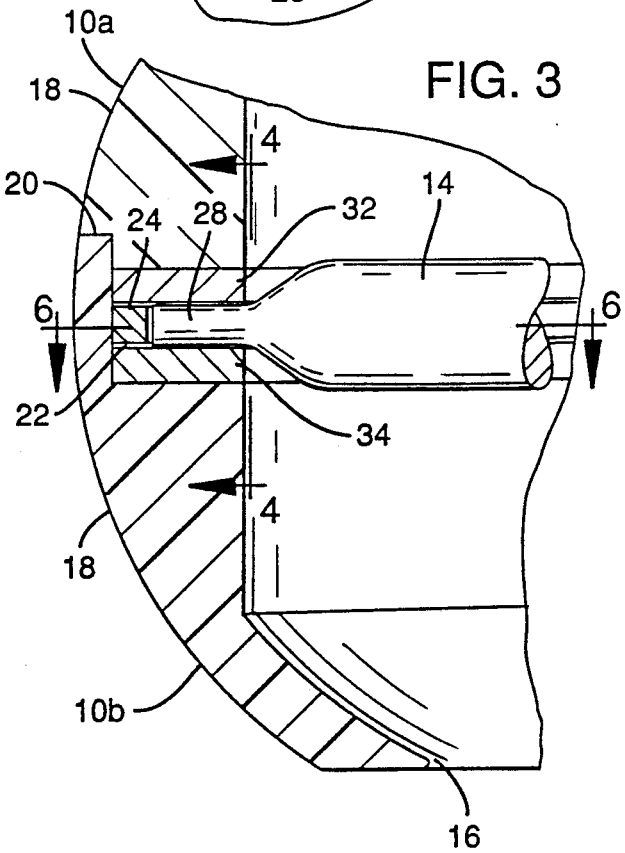
FIG. 3 is an enlarged fragmentary sectional view showing a joint portion of the device and also detailing an improved bearing surface that contributes to more efficiency of rotation and quiet operation.

With reference to FIGS. 1–4, the gyroscopic device of the invention comprises a hollow housing structure 10 with a pair of halves 10*a* and 10*b* respectively. The device assumes an overall shape of a sphere and is preferably of a size that can be grasped in the hand over one end, preferably over end 10*a*. The housing supports a rotor 12 mounted on a shaft 14 that provides a spin axis for the rotor, referred to herein as the first axis. The housing has an opening 16 at the end of section 10*b* serving as an engagement area for the rotor to initiate rotation thereof. The sides 18 of the housing adjacent the middle of the housing are thickened and include a stepped joint 20 between the housing sections. Stepped joint 20 includes a horizontal circular race or groove 22 between the sections that receives a guide ring 24 with sufficient clearance so that the ring can rotate circumferentially in the race 22. The ring 24 has diametrically spaced notches 26 which receive reduced ends 28 of the shaft 14 in a free fit so that these shaft ends can make rolling contact with the upper and lower surfaces of the race.

The opposed lining portions 32 and 34 of race 22 are adhesively secured in place and comprise linings of preselected and required characteristics. It is required that such material be long wearing and have a coefficient of friction and an abrasion resistance such that it will contribute efficiently to rolling precession of the shaft ends. An elastomeric urethane, or other material having a static coefficient of friction of from 1.3 to 0.73 and a dynamic coefficient of friction of from 0.69 to 0.54, is satisfactory and desired. With this friction surface engagement for the reduced shaft portions, an efficient rolling drive of shaft ends 28 around the race 22 will be provided, as will be more apparent hereinafter. Also, guide ring 24 is constructed of a material that will slide circumferentially in a substantially friction free and efficient manner in the race 22, as will also be more apparent hereinafter, whereby the rotor and guide ring can rotate about the central axis of the ring, i.e. a second axis. Any suitable material of low or medium friction characteristics can be used for the guide ring since it is of light weight and merely slides in the race 22.

To activate the gyroscope, the rotor is given an initial spin such as by hand engagement thereof through open end 16 or by running the device along a surface. The device is then grasped in the hand over the closed end of the housing, preferably with the shaft 14, namely, a first or spin axis of the rotor, designated by the numeral 36 in FIG. 2, being in a substantially horizontal plane. The device is then given a manual gyrating motion in either direction so that movement of a second axis 38, namely, the axis of rotation of the rotor circumferentially in the race 22, follows approximately the surface of a cone having its apex above the device. This gyrating movement by the operator results in torque placed at right angles to both the first or spin axis 36 of the rotor and the second or precession axis 38 of the rotor. This manually applied torque about the third axis 40 is resisted by the spinning rotor in accordance with the physical laws governing gyroscopic motion. This resistance of the rotor 12 to move about the third axis 40, will be felt by the operator who is trying to, in effect, force the spinning rotor to precess about the second axis 38. The operator feels the resistance of the spinning rotor and soon learns to respond by applying an appropriate torque in a gyrating fashion about the third axis 40. The operator can, by varying the amount of applied torque, attain and maintain a wide range of rotor speeds on both the first and second axes 36 and 38, respectively.

The cone-like action by the operator to produce precession of the rotor causes forced engagement of the shaft ends 28 against the groove layers 32 and 34 as these ends roll thereon. The substantially friction free circumferential rotation of the guide ring 24 in the race 22 against these layers as well as the friction rolling contact of the shaft ends 28 against these layers provides efficient operation of the rotor. That is, the engagement of the ends of the shaft against the friction producing urethane rings 32 and 34 and the low friction engagement of guide ring 24 in the race groove 22 contribute to the efficiency of operation of the device in precessing movement. Also, less energy is required to start and to operate it. The engagement of the shaft ends with the urethane layers 32 and 34, although providing good precessing movement of the rotor, is of a sufficiently low rolling friction of the shaft on its axis 36 such that there will be no appreciable drag on free spinning of the shaft on its axis 36. Another important feature of the housing construction comprises the separation of the halves 10*a* and 10*b* at the groove 22 wherein by lifting off one half, the half which contains the rotor allows for repair, maintenance and replacement of parts.

Figure 5:
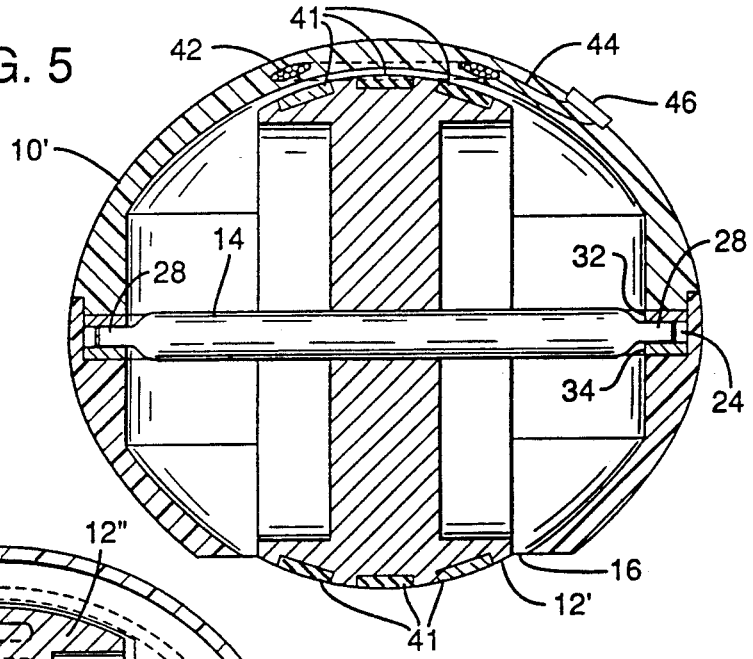
FIG. 5 is a sectional view taken similar to FIG. 3 illustrating means associated with the device for generating electricity and energizing exteriorly visible display means on the housing.

Another concept as well as a precess of the invention is to use the precessing rotary motion of the rotor 12 to generate electricity for operating various electrical visual and/or audio devices. One concept of generating electricity is to mount one or more permanent magnets 41, FIG. 5, in the outer periphery of the rotor 12' and to embed a coil 42 in the housing 10'. Coil 42 is in a circuit which in one illustration of the invention may comprise a main circuit wire 44 leading from one end of the coil 42 and extending through visual and/or audio devices 46, to be described. Circuit wire 44 and devices 46 are suitably embedded in the housing for completing the circuit to opposite ends of the coil. As the rotor develops speed, electricity will be generated in the coil and the visual and/or audio device 46 will be energized. The devices if visual will be located in the housing such that they will be visible when the hand is grasped on the housing.

Figure 6:
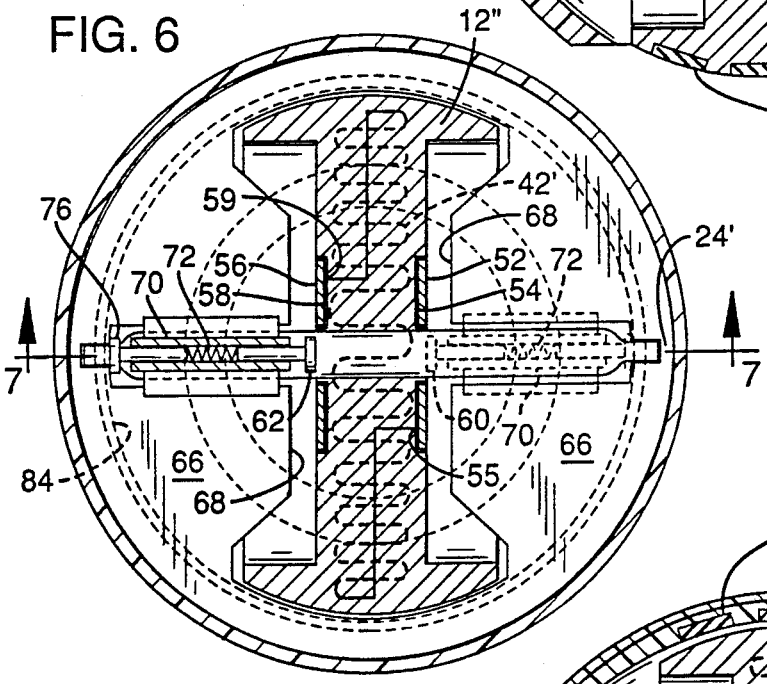
FIG. 6 a cross sectional view of the device taken on the line 6—6 of 3 but showing a second form of electric generating means that can be associated with the device.
Figure 7:
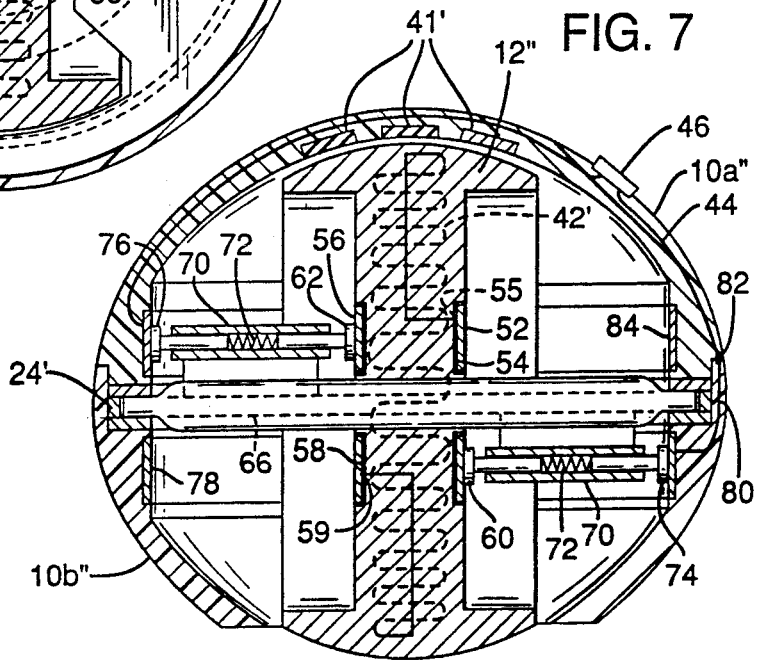
FIG. 7 is sectional view taken on the line 7—7 of FIG. 6.

FIGS. 6 and 7 illustrate a reversal of the electrical generating means. More particularly, permanent magnets 41' are embedded in the housing parts 10*a*" and/or 10*b*" and the coil 42' of the generator is mounted on the rotor 12". One side surface of the rotor has an electrically conducting flat ring or surface 52 insulated from the rotor by an insulating layer 54 and connected at 55 to one end of coil 42'. The other side of rotor 12" has an electrically conducting flat ring or surface 56 insulated from the rotor by an insulating layer 58 and connected at 59 to the other end of coil 42'. The electrically conducting rings 52 and 56 are associated with respective brushes 60 and 62 supported on a plate-like extension 66 of ring 24, which in addition to supporting the brushes serves the same function of engagement of opposite ends of the shaft 14 as the ring 24 described in connection with FIG. 1. This plate-like member has slot portions 68 on opposite sides of the rotor for receiving the rotor and its shaft. Electrically conducting brushes 60 and 62 are slidably mounted in housings 70 and have spring biased movement toward the rotor 12" by springs 72 in the housings, whereby to maintain the brushes in constant contact with the rings 52 and 56.

Housings 70 for brushes 60 and 62 also carry second brushes 74 and 76, respectively, on their other ends which are also biased outwardly by the springs 72. Brush 74 is in electrical contact with a ring 78 of electrically conducting material mounted in the inwardly facing surface of the housing part 10*b*". Ring 78 is connected in circuit with a main circuit wire 44 through a connecting wire segment 80 leading from the ring to an electrically conducting disconnect 82 between the two housing sections. Brush 76 is in electrical contact with a ring 84 of electrically conducting material mounted in the inwardly facing surface of the housing part 10*a*" and connected to the circuit wire 44. Wire 44 serves the same purpose as wire 44 in FIG. 5, namely, to provide a power circuit for visual and/or audio devices 46. As the rotor 12" rotates, electricity is generated, the rings 78 and 84 being arranged to maintain a circuit from the brushes as precessing occurs.

Figure 8:
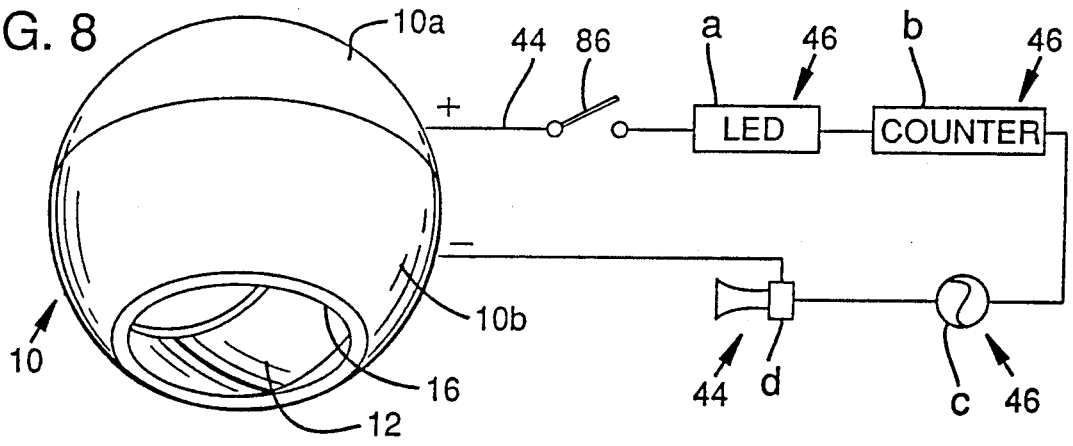
FIG. 8 a schematic diagram showing types of visual and audio electrical components that can be used in combination with the present device.

FIG. 8 illustrates various visual and/or audio devices 46 that can be incorporated in the circuit 44. As an example, these devices can include lights a of various forms such as LED's in selected patterns, a counter or counters b such as a digital means for designating total number of revolutions of the rotor or rpm's thereof, a beam light c that may serve as a flashlight, and sound producing means d. Other devices can also be powered for entertainment or functional purposes. The circuit may also include an on/off switch 86 that can be manually operated or can comprise an automatic cut-in or cut-out switch. Such switch can be used to maintain the visual and audio devices in off condition until the rotor has developed a selected speed whereby to prevent a magnetic drag on the rotor in its initial starting revolutions, thus allowing for easier starting of the rotor.

In order to provide an efficiently operating rotor, it must be precisely balanced.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A gyroscopic device comprising:

a housing, a balance gyroscopic rotor in said housing, shaft means integrated with said rotor providing a spin axis for said rotor, support means in said housing receiving opposite ends of said shaft means for rotation of said shaft means and rotor about said spin axis and providing for rotation of said shaft means and rotor relative to said housing about a second axis at right angles to said spin axis, said support means including continuous circular track means in said housing concentric with said second axis and positioned on opposite sides of and adjacent the ends of said shaft means for rolling contact by end portions of said shaft means when a torque is applied to said housing about a third axis at right angles to both said spin axis and second axis to cause precession of said shaft means and rotor about said second axis, said track means comprising a circumferential race in said housing with opposed lining portions of a type having a friction surface engagement with said end portions of said shaft means to provide an improved non-slipping, rolling movement of said shaft means and rotor, and guide ring means in said race having notches receiving end portions of said shaft means and establishing a drive connection between said shaft means and said guide ring means in the rotation of said shaft means and rotor about said second axis, said guide ring means having free sliding movement against said opposed surfaces of said groove.

2. The gyroscopic device of claim 1 wherein said lining portions are constructed of a material having a coefficient of friction and an abrasion resistance to elastomeric urethane.

3. The gyroscopic device of claim 1 wherein said lining portions have a static coefficient of friction of from 1.3 to 0.73 and a dynamic coefficient of friction of from 0.69 to 0.54, as in elastomeric urethane.

* * * * *